United States Patent [19]

Sutherland

[11] 4,128,084

[45] Dec. 5, 1978

[54] ROTARY ENGINE

[75] Inventor: Alexander R. Sutherland, Sydney, Australia

[73] Assignee: Iris Jean Carrington Sutherland, Sydney, Australia; a part interest

[21] Appl. No.: 706,954

[22] Filed: Jul. 20, 1976

[30] Foreign Application Priority Data

Jul. 25, 1975 [AU] Australia ..... 2520/75

[51] Int. Cl.[2] ..... F02B 75/22

[52] U.S. Cl. ..... 123/55 AA; 74/804; 91/491

[58] Field of Search ..... 123/55 A, 55 AA, 90.17; 92/68, 148; 91/491; 74/804

[56] References Cited

U.S. PATENT DOCUMENTS

| | | | |
|---|---|---|---|
| 1,445,474 | 2/1923 | Benson et al. | 123/55 AA |
| 1,533,514 | 4/1925 | Ragot | 123/55 AA |
| 1,561,179 | 11/1925 | Mayer | 92/148 |
| 2,371,005 | 3/1945 | Wagers | 123/55 AA |
| 2,390,229 | 12/1945 | Thompson | 74/804 |
| 2,888,837 | 6/1959 | Hellmann | 123/90.17 |

FOREIGN PATENT DOCUMENTS

| | | | |
|---|---|---|---|
| 474674 | 11/1937 | United Kingdom | 123/55 AA |

*Primary Examiner*—Charles J. Myhre
*Assistant Examiner*—Craig R. Feinberg
*Attorney, Agent, or Firm*—Mahoney, Schick & Cislo

[57] ABSTRACT

The present invention discloses a rotary engine having a cylindrical stator with a plurality of radially arranged cylinders each having a piston, a shaft is rotatably mounted co-incident with the longitudinal stator axis, and an orbitor having a cylindrical interior encompasses the stator. Sequentially phased reciprocation of the pistons is transmitted to the orbitor which orbits about the shaft axis in a "polishing-cloth" motion without rotation or revolution of the orbitor. A gear mechanism converts the orbital motion of the orbitor to rotation of the shaft.

4 Claims, 7 Drawing Figures

ROTARY ENGINE

The invention relates to internal combustion engines and provides an engine in which linear thrust from a power source is transmitted by a planetary orbitor to a rotatable shaft.

Hitherto rotary engines have suffered from the problem of sealing in that the rotor of the engine generally sweeps a curved surface and sealing must be provided between the sweeping edge of the rotor and the inner surface of the stator. Since this sealing is interposed between a region of high pressure where combustion is taking place and a region of relatively low pressure, poor quality sealing results in reduced performance of other types of rotary engine.

It is an object of the present invention to overcome this problem by the use of pistons and conventional piston rings to seal same since such sealing methods have been well tried and been found to be very effective.

This object is achieved according to the present invention by an internal combustion engine comprising a shaft axially rotably mounted within a stator, said stator having a plurality of angularly spaced cylinders extending radially away from the shaft axis, each of said cylinders having a reciprocable piston therein, means to reciprocate said pistons in sequentially phased relationship, an orbitor encompassing said stator and mounted for orbital motion about said shaft axis, means operatively associated with each piston, the stator and the orbitor to engage each piston with a corresponding location on said orbitor whereby sequentially phased reciprocation of said pistons induces orbital motion in said orbitor, and gear means interposed between said shaft and said orbitor to rotate said shaft in response to the orbital motion of said rotor.

Figure 1:
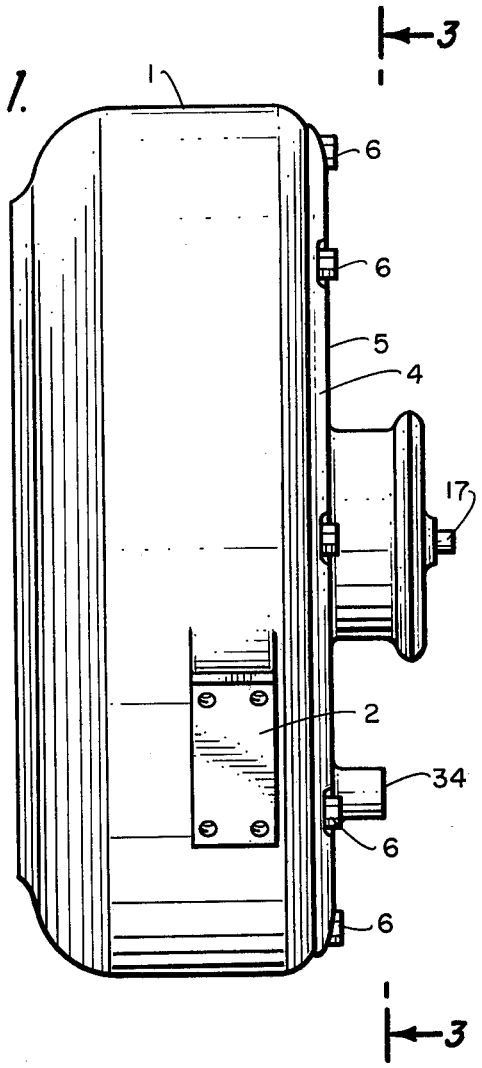
Figure 2:
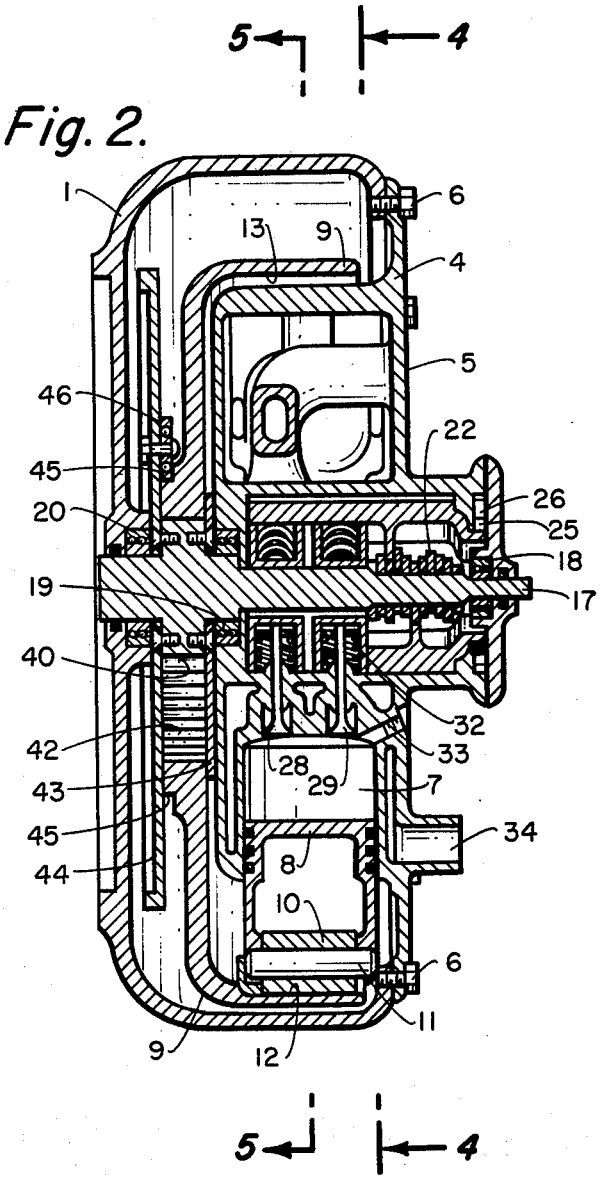
Figure 3:
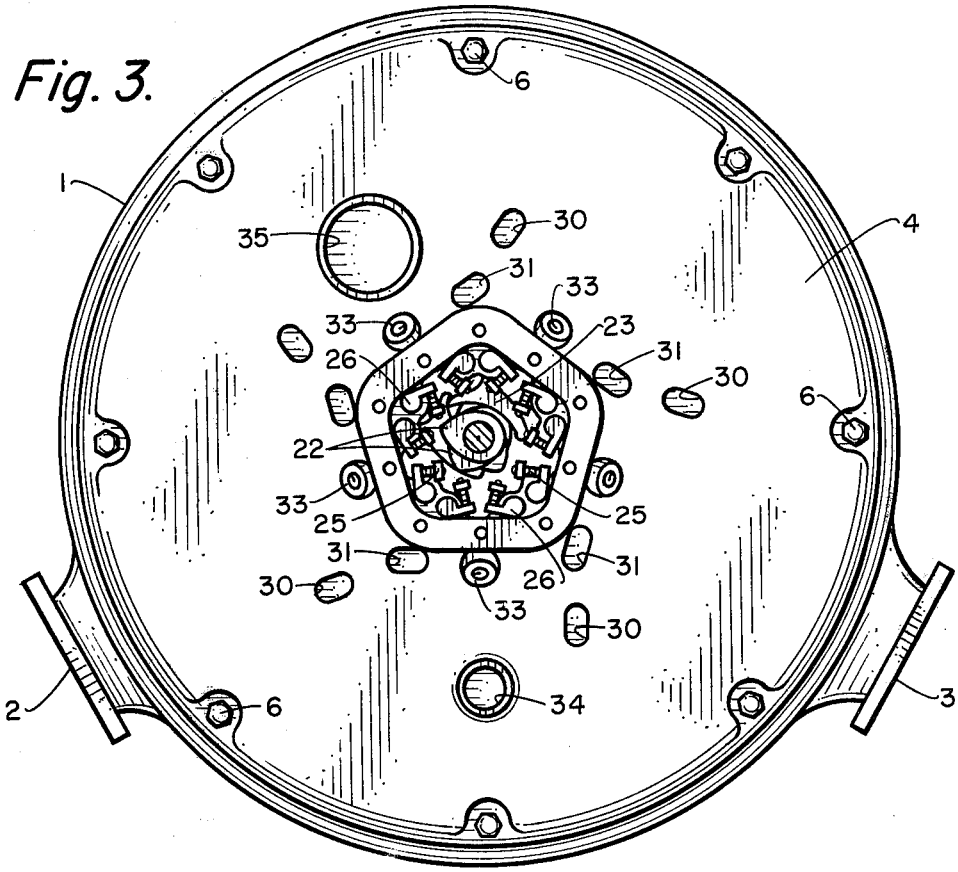
Figure 4:
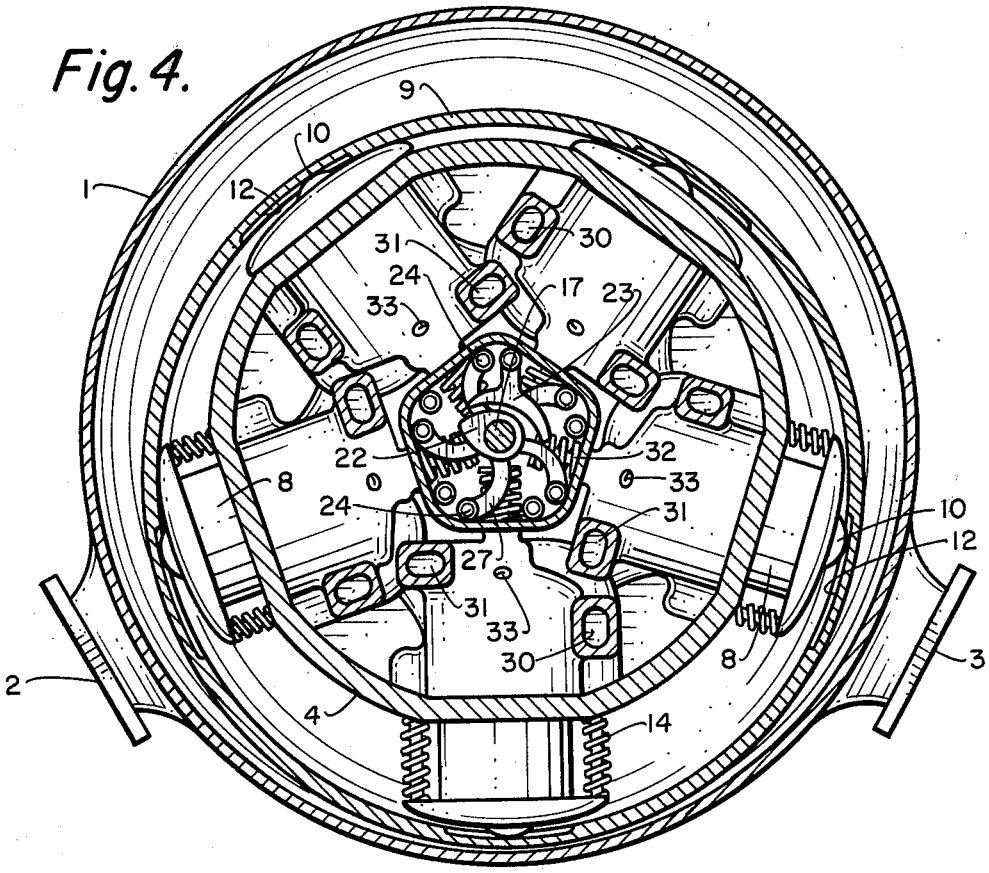
Figure 5:
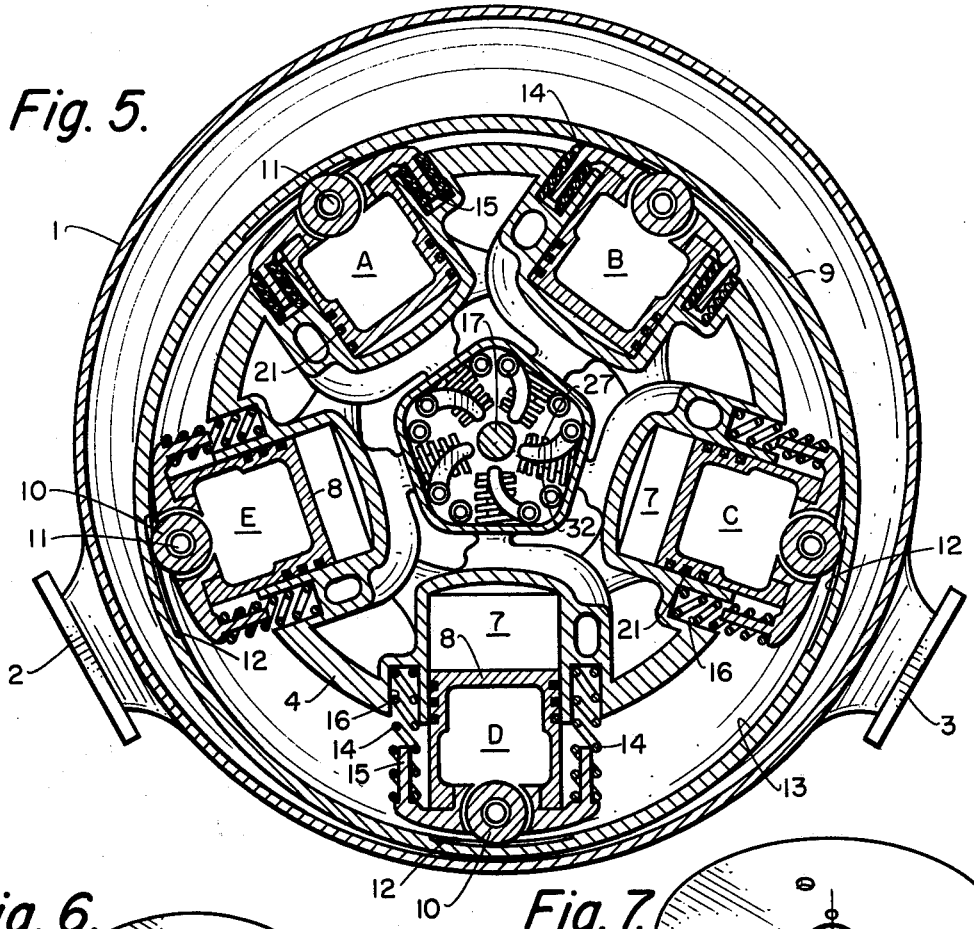
Figure 6:
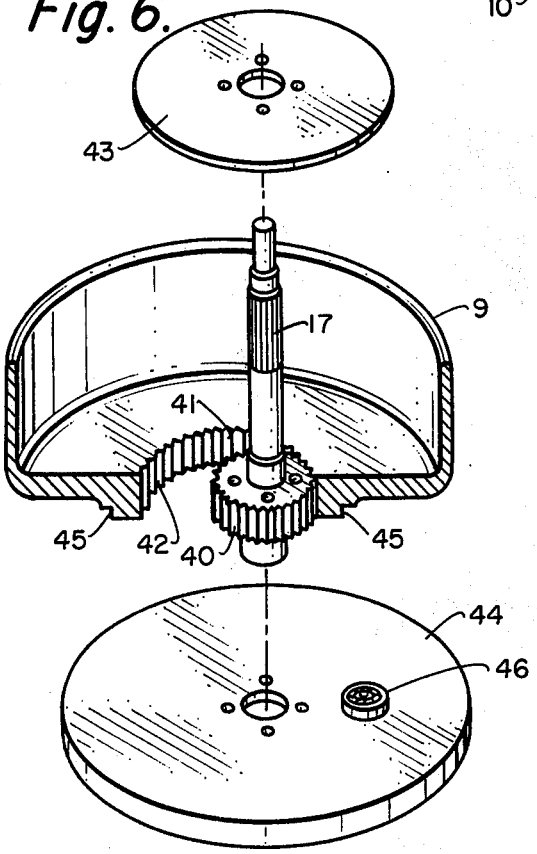
Figure 7:
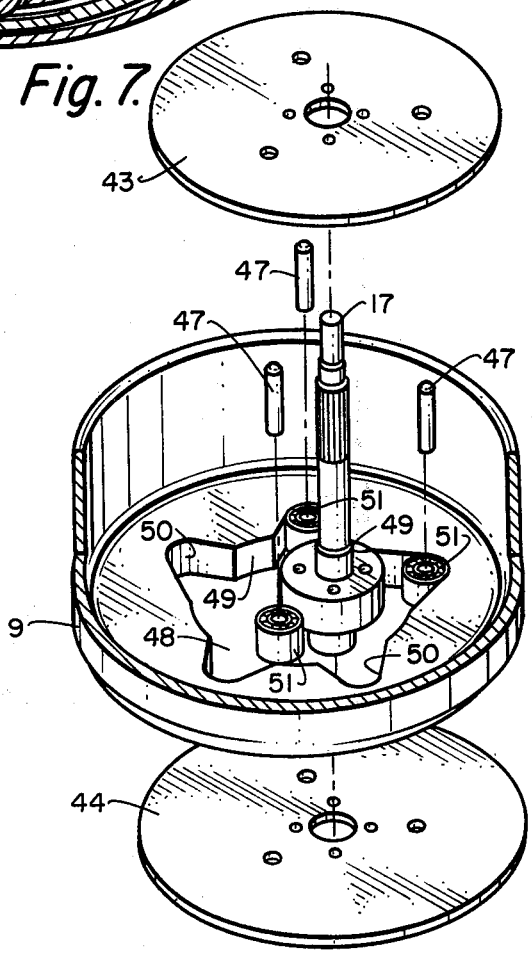

One embodiment of the internal combustion engine of the present invention will now be described with reference to the drawings in which:

FIG. 1 is a side elevation of a preferred 5 cylinder embodiment of the present invention showing the engine housing, FIG. 2 is a longitudinal section of the engine of FIG. 1, FIG. 3 is a transverse cross-section taken along the line 3—3 of FIG. 1, FIG. 4 is a transverse cross-section taken along the line 4—4 of FIG. 2, FIG. 5 is a transverse cross-section taken along the line 5—5 of FIG. 2, FIG. 6 is an exploded schematic perspective view of a first embodiment of the driving gears, and FIG. 7 is an exploded schematic perspective view of a second embodiment of the driving gears.

Referring now to FIGS. 1 to 5, the internal combustion engine of the preferred embodiment comprises a generally cylindrical housing 1 having two mounting legs 2 and 3 (FIG. 3). Centrally located within the housing 1 is a stator 4 (FIG. 2) having an end flange 5 which is rigidly secured to the stator 4 by means of bolts 6. Therefore the stator 4 and housing 1 are fixed to each other.

As best seen in FIG. 5, the stator 4 has five radially extending cylinders 7 which open radially outwardly towards the housing 1. Each cylinder 7 has a corresponding piston 8 reciprocally movable therein. The pistons 8 are located between the cylinders 7 of the stator 4 and an orbitor 9 having a substantially cylindrical configuration. The pistons 8 are sealed within the cylinders 7 by means of conventional rings 21.

Each piston 8 has a hardened steel roller 10 rotatably mounted on an axle 11. The rollers 10 and axles 11 extend longitudinally (FIG. 2) and the rollers 10 are each located in a corresponding track or groove 12. The grooves 12 have a longitudinal extent sufficient to accommodate the rollers 10 and only a limited circumferential extent around the inner wall 13 of the orbitor 9. The roller 10 of each piston 8 is maintained in contact with the corresponding groove 12 by means of two helical springs 14 interposed between two pegs 15 and corresponding recesses 16.

An axial longitudinally extending shaft 17 (FIG. 2) is rotatably mounted in the stator 4 and housing 1 by means of bearings 18, 19 and 20. Splined to the shaft 17 are a plurality of cams 22 (FIGS. 2 and 3) which control the timing and operation of the inlet and outlet valves 28 and 29 (FIG. 2) for each cylinder 7. Because each am 22 is splined onto the shaft 17 this enables finee integral steps of valve timing to be achieved because the position of each cam 22 is individually adjustable.

As seen in FIGS. 3 and 4, on rotation of the shaft 17, cams 22 rotate shoes 23 and thereby move adjustment screws 25, each of which is secured to a corresponding shoe 23. The movement of each adjustment screw 25 is transmitted to a corresponding rotary lever 26. Each rotary lever is secured to one end of a corresponding longitudinally aligned, rotatably mounted timing rod 24 (FIG. 4). The other end of each timing rod 24 is connected to a valve lifter 27 and the movement of each rotary lever 26 causes rotation of the corresponding timing rod 24 and operation of the corresponding valve lifter 27 to operate one of the valves 28 or 29 (FIG. 2).

The valves 28 and 29 control the intake of combustible gases into the cylinders 7 via inlet ports 30 (FIG. 4) and the expulsion of the exhaust gas produced by combustion via outlet ports 31. The movement of the valves 28 and 29 is controlled by operation of the valve lifters 27 against the resilience of helical springs 32 which urge valves 28 and 29 into their closed position.

It will therefore be seen that the pistons 8 are reciprocable within the cylinders 7 and that combustible gases may be introduced into and exhaust gases expelled from the cylinders 7. Thus conventional internal combustion may be achieved with 4 stroke operation being the desired mode of operation of the engine of the preferred embodiment. The necessary spark plug for each cylinder 7 is locatable within the corresponding aperture 33 and cooling water is introduced into the stator 4 via an inlet 34 (FIGS. 2 and 3) and removed therefrom via outlet 35 (FIG. 3).

The operation of the internal combustion engine of the preferred embodiment will now be described with reference to FIG. 5. The pistons 8 are reciprocable within the cylinders 7 in a phased sequential operation. The five pistons 8 of FIG. 5 are each in one piston of a single stroke, the 2 uppermost pistons A and B are respectively just approaching towards and departing from top dead center while the lowermost piston D is at bottom dead center.

Because piston D is at bottom dead center the orbitor 9 in the vicinity of piston D is spaced from the stator 4, in the vicinity of piston D, by a maximum extent. Similarly the orbitor 9 in the vicinity between pistons A and B is very close to stator 4.

As piston D moves towards top dead center, piston A moves to bottom dead center and thus the orbitor 9 moves so that the orbitor 9 in the vicinity of piston A is spaced from the stator 4 by a maximum extent. When piston D reaches top dead center the orbitor 9 in the vicinity of piston D will then be very close to the stator 4. The firing order is A, C, E, B, D, A and so on.

It will therefore be seen that as the pistons 8 execute one complete stroke, the orbitor 9 moves through an "orbit" such that every point on the orbitor 9 moves radially inwards and outwards along a line extending radially from the shaft 17. The orbitor 9 does not rotate or revolve but rather maintains the same orientation during the "orbit". Therefore the geometric center of the orbitor 9 moves in a locus which is a circle co-axial with the shaft 17. It may be said that the orbitor 9 executes a circular planetary orbit about the axis of the shaft 17 but the orbitor 9 does not rotate in any way about its own axis, save for a slight oscillatory rotational movement of only a few degrees caused by each roller 10 moving backwards and forwards along its track 12 as the corresponding piston 8 completes each stroke.

The movement of the orbitor 9 may best be visualized by considering the motion of a polishing cloth held against a window pane, say, by the hand of a person as that person moves his hand in a circular polishing action without twisting his wrist. It will be seen that under these circumstances the polishing cloth moves in a circular path or orbit but does not rotate.

The longitudinal reciprocating motion of the pistons 8 produces planetary orbital motion of the orbitor 9. This motion of the orbitor 9 is applied to the driving gears of the engine to produce rotation of the shaft 17.

A first embodiment of driving gears suitable for the engine of the preferred embodiment is illustrated in FIGS. 2 and 6. The driving gears comprise an internal gear mechanism formed by spur wheel 40 formed on and rotatable with the shaft 17. The orbitor 9 has an internal, toothed cylinder surface 41 having teeth 42.

The cavity between spur wheel 40 and surface 41 is covered on one side by a slide plate 43 which is secured to the spur wheel 40 and is in sliding contact with the orbitor 9 to prevent ingress of dirt and foreign matter into the abovementioned cavity. A flywheel 44 is also secured to the spur wheel 40 and is in sliding contact with one surface of a collar 45 on the orbitor 9 to cover the other side of the abovementioned cavity.

A ball bearing 46 is mounted on the flywheel 44 at a predetermined radial distance from the shaft 17 so that the outer surface of the ball bearing 46 bears against the outer cylindrical surface of the collar 45 to maintain meshing engagement between the spur wheel 40 and a portion of the toothed surface 41.

It will therefore be seen that shaft 17 is constrained by bearings 18, 19 and 20 so that only rotation of shaft 17 about its longitudinal axis is possible while orbitor 9 executes the above-described "polishing-cloth" orbital motion. Therefore as the orbitor 9 is driven by the pistons 8, the meshing between spur wheel 40 and toothed surface 41 obliges shaft 17 to rotate. The speed of rotation of the shaft 17 relative to the speed of orbit of the orbitor 9 is determined by the ratio of the number of teeth on spur wheel 40 and surface 41.

The outer surface of flywheel 44 is preferably also toothed so as to provide a driving gear for a water pump, oil pump, distributor, breaker points (all not shown) and so on.

In FIG. 7, another embodiment of a driving gear mechanism suitable for the internal combustion engine of the preferred embodiment is illustrated. The gear mechanism comprises the shaft 17, slide plate 43 and flywheel 44 as before save that ball bearing 46 is no longer required. The flywheel 44, slide plate 43 and shaft 17 are secured together by means of pins 47.

The orbitor 9 has an internally scalloped quasi-sinusoidal surface 48 preferably having the same number (5) of crests 49 as cylinders 7. The number of cylinders 7 is preferably selected to be an odd number for better harmonic cancellation of vibration. Intermediate each crest 49 is a trough 50.

A roller bearing 51 is mounted on each of the pins 47. The number (3) of roller bearings 51 is two less than the number (5) of crests 49.

Again shaft 17 is constrained by its mounting so that it is only able to rotate about its longitudinal axis. As the orbitor 9 undergoes its orbital motion, the roller bearings 51 are engaged sequentially by the troughs 50 so that two of the roller bearings 51 are always engaged by the troughs 50. In this way the orbital motion of the orbitor 9 is converted to rotational motion of the shaft 17.

The ball bearing 46 is required for the gear mechanism illustrated in FIG. 6 since when the engine is not running the compression in each of the cylinders tends to even out. Thus the orbitor 9 would tend to move so as to disengage the spur wheel 40 with the toothed surface 41. During running of the engine the interaction of the pistons 8 with the orbitor 9 keeps the toothed surface 41 and spur wheel 40 engaged and this interaction is assisted by the ball bearing 46.

However, in the gear mechanism illustrated in FIG. 7, the ball bearing 46 is not required since at least one of the roller bearings 51 will always lie at least partially engaged with one of the troughs 50.

The foregoing describes only some embodiments of the present invention and modifications, obvious to those skilled in the art, may be made thereto without departing from the scope of the present invention. For example, the number of cylinders may be varied and need not be an odd number. Furthermore the internal combustion engine need not operate on a 4-stroke cycle since 2-stroke or diesel operation may also be achieved.

In addition, the cylinders need not extend to the peripheral stator surface but rather may be located within the stator. Under such an arrangement, the piston within each cylinder would be connected to the inner surface of the orbitor by means of a connecting rod or link.

I claim:

1. An internal combustion engine comprising a stator, a shaft rotatably mounted in and supported by the stator, a plurality of cylinders mounted on the stator with their axes radially arranged relative to the shaft axis and angularly spaced around the shaft axis, a piston reciprocately mounted in each cylinder, an orbitor fixed to the shaft, a gear fixed to the shaft, a toothed bore in the stator larger in diameter than said gear, a track on the stator concentric with the toothed bore, a roller mounted on the orbitor with the axis of rotation of the roller eccentric to but parallel with the shaft axis and with the roller engaging said track to maintain meshing engagement between some teeth of the gear and some teeth of said toothed bore, a follower on each piston, curved support surface means on the orbitor concentric with the shaft axis and resilient means to urge the followers into contact with said support surface means.

2. The engine as claimed in claim 1, wherein a housing encompasses said orbitor and is secured to the stator.

3. The engine as claimed in claim 1 including an inlet and an exhaust valve opening into the radially inner end of each of said cylinders, resilient means to urge said valves into a closed position and a corresponding mechanical linkage to move each said valve against its associated resilient means to open said valve wherein each said mechanical linkage is operable by a cam surface rotatable by said shaft.

4. The engine as claimed in claim 3 wherein each said cam surface is the surface of a cam splined onto said shaft thereby making the time of operation of each said mechanical linkage independently adjustable by discrete periods of time.

* * * * *